United States Patent [19]

Kosmahl

[11] 4,395,656

[45] Jul. 26, 1983

[54] GYROTRON TRANSMITTING TUBE

[75] Inventor: Henry G. Kosmahl, Olmsted Falls, Ohio

[73] Assignee: The United States of America as represented by the United States National Aeronautics and Space Administration, Washington, D.C.

[21] Appl. No.: 220,212

[22] Filed: Dec. 24, 1980

[51] Int. Cl.[3] ..... H01J 25/00

[52] U.S. Cl. ..... 315/4; 315/3; 315/5; 315/5.35; 315/5.38

[58] Field of Search ..... 315/3, 4, 5, 5.35, 5.38

[56] References Cited

U.S. PATENT DOCUMENTS

| | | | |
|---|---|---|---|
| 3,302,053 | 1/1967 | Udelson | 315/5.38 X |
| 3,433,992 | 3/1969 | Tancredi et al. | 315/5.38 X |
| 3,463,959 | 8/1969 | Jory et al. | 315/4 |
| 3,614,516 | 10/1971 | Phillips | 315/5.35 |
| 3,764,850 | 10/1973 | Kosmahl | 315/5.38 |
| 4,207,495 | 6/1980 | McDowell | 315/5.38 |

*Primary Examiner*—Saxfield Chatmon, Jr.

*Attorney, Agent, or Firm*—Norman T. Musial; John R. Manning; James A. Mackin

[57] ABSTRACT

An improved R.F. transmitting tube for the 20 GHz to 500 GHz range comprises a gyrotron (10) and a multistage depressed collector (11) as shown in FIG. 1. A winding (19) provides a magnetic field which acts on spent, spinning or orbiting electrons changing their motion to substantially forward linear motion in a downstream direction.

The spent electrons then pass through a focusser (18) into the collector (11). Nearly all of the electrons injected into the collector will remain within an imaginary envelope designated by dashed lines 8 and 9 as they travel forward toward the end collector plate (26). The apertures in the collector plates (22–25) are at least as large in diameter as the envelope (8,9) at any particular axial position.

FIG. 2 illustrates magnetic field strength from the cathode (13) of FIG. 1 to the collector entrance in focusser 18.

8 Claims, 2 Drawing Figures

AXIAL DISTANCE

FIG. 2

AXIAL DISTANCE

GYROTRON TRANSMITTING TUBE

DESCRIPTION

ORIGIN OF THE INVENTION

This invention was made by an employee of the United States Government and may be manufactured or used by or for the Governmen without the payment of any royalty thereon or therefor.

TECHNICAL FIELD

This invention relates to radiofrequency transmitting tubes operating in the 20 GHz to 500 GHz range and is directed more particularly to a gyrotron type oscillator of amplifier tube.

Since the beginning of the space age, many communication satellites have been placed in geosynchronous orbit above the earth. Recent evaluations of satellite communications indicate that in the coming decades there will be such an increasing demand for satellite-to-earth communications that the capacity limits of the frequency bands of presently used satellites will be exceeded.

In order to transmit increasing amounts of information, it will be necessary to go to higher radio frequency (R.F.) transmission bands. Satellite transmitters operating in the 30/20 GHz range are presently under development. However, it is expected that frequencies will eventually reach the 100 GHz to 500 GHz range and even beyond.

A device capable of generating electromagnetic radiation in the 20 GHz to 500 GHz range is the gyrotron. Gyrotrons are presently used for R.F. heating; for example in fusion and plasma work and for military applications.

In a gyrotron, electrons emitted by a cathode are forced by a magnetic field to follow generally helical paths as they move through the field in a direction away from the cathode. As the electrons leave the field with which they have interacted to generate R.F. electromagnetic waves, the diameters of the paths of their angular rotation or orbits increase dramatically making them very difficult, if not impossible, to collect with reasonable efficiency.

The reason it is impractical to convert an electron's azmuthal kinetic energy $T=\frac{1}{2}m(r\cdot\dot{\theta})^2$ into electrical energy efficiently is because $\dot{\theta}$ which is the angular velocity of a given electron is determined entirely by the local magnetic field. However, the energy of the particular electron also depends strongly on the radius of its orbit. Thus, for a given 0 azmuthal kinetic energy T is proportional to the orbit radius squared at Z=a constant where Z is a given magnetic potential. Consequently it will be seen that it is impractical to place electrodes for extracting rotational energy from spent spinning electrons at a given magnetic potential Z=constant.

BACKGROUND ART

U.S. Pat. No. 3,702,951 to Kosmahl incorporated herein by reference discloses a high efficiency multistage depressed collector for use with a source of charged particles such as spent electrons. Each electrode plate of the collector has a central aperture with the apertures increasing in diameter in a downstream direction from the source of charged particles. The electrode plates are generally bowed towards the source of charged particles with the final electrode plate being conical and having a spike extending toward the source of charged particles.

U.S. Pat. No. 3,764,850 to Kosmahl also incorporated herein by reference discloses an electron beam controller in which a magnetic field of predetermined intensity and shape is applied to a spent electron beam to refocus the spent electrons prior to their injection into a collector.

U.S. Pat. No. 3,463,959 to H. R. Jory et al discloses a charged particle accelerator apparatus including means for converting a rotating helical beam of charged particles having axial motion into a non-rotating beam of charged particles. This is accomplished by utilizing crossed electric and magnetic fields. The energy of the beam is not changed while the type of motion is substantially altered.

U.S. Pat. No. 4,199,709 to Jean-Louis Alirot et al discloses an injector for an annular beam of monokinetic electrons in helical orbits having a high inclination angle relative to the axis of the helix of the type having an annular electron gun in a revolving vacuum enclosure.

None of the above patents are concerned with converting the azmuthal energy of spiralling electrons into longitudinal kinetic energy and injecting the electrons into a collector at high efficiency.

DISCLOSURE OF THE INVENTION

In accordance with the present invention, there is provided a gyrotron device having a multistage depressed collector. The magnetic field imposed on electrons in the gyrotron causes them to take generally helical paths with the diameter of the orbit of each electron being relatively constant in the magnetic field. As the spiralling electrons leave the magnetic field, they encounter a refocusing magnetic field which tapers from the B value of the first magnetic field to substantially zero over a distance of from 1 to 3 wavelengths. The orbital or spiralling motion of the electrons is convered into substantially linear motion in order that they may be injected into a multistage depressed collector at high efficiency.

BRIEF DESCRIPTION OF THE DRAWINGS

The details of the invention will be described in connection with the accompanying drawings in which.

DESCRIPTION OF THE PREFERRED EMBODIMENT

Figure 1:
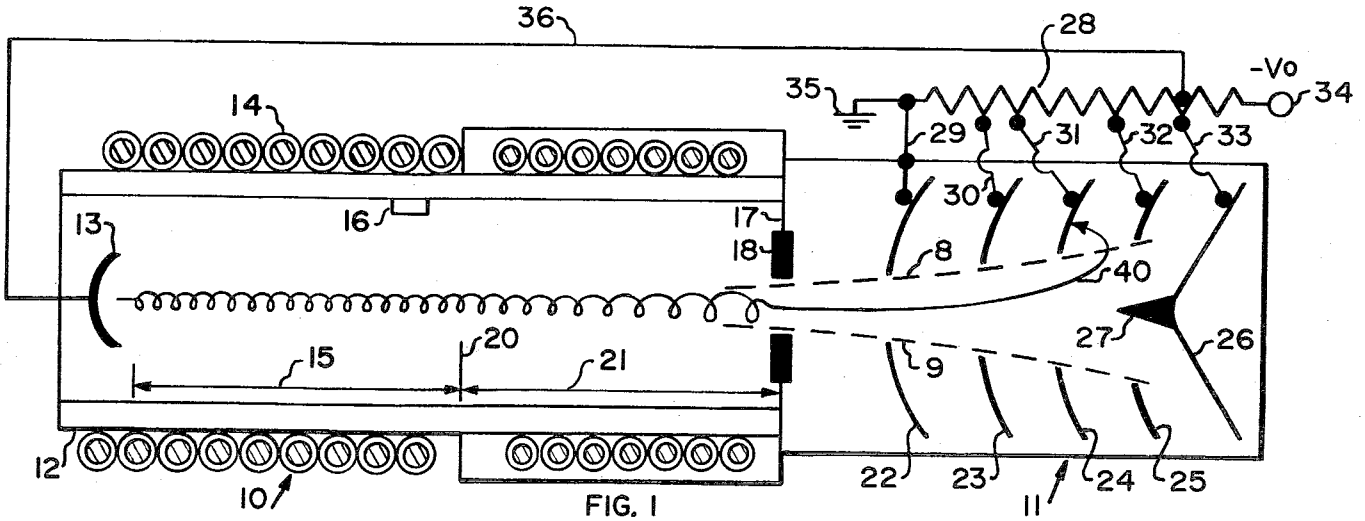
FIG. 1 is a schematic, longitudinal section of a gyrotron embodying the invention.

Referring now to FIG. 1, there is shown in accordance with the invention a schematic drawing of a gyrotron transmitting tube 10 and a multistage depressed collector 11. The gyrotron tube 10 is comprised of a cylindrical tube 12 having an electron emitting cathode 13 at one end. A current carrying solenoid winding 14 establishes a magnetic field with which electrons emitted by cathode 13 interact to produce radio frequency energy which is transferred to a suitable antenna (not shown) by means of an RF output coupler 16. The double ended arrow 15 defines an interaction region which is the axial length of the magnetic field provided by solenoid 14.

At the other end of the gyrotron tube 10 is an end wall 17 which includes a ring of magnetic material 18 through which electrons are injected into the collector 11. A focusing coil 19 disposed around the gyrotron tube 10 between the solenoid 14 and the collector 11 provides a magnetic field, the strength of which tapers from a value B equal to that of the solenoid field to substantially zero at the focusing ring 18.

The refocusing field is maximum at the upstream end of the solenoid field nearest the cathode as indicated by line 20 and declines to zero over the axial distance indicated by the double-ended arrow 21. The strength and shape of the refocusing field is in accordance with the teachings of U.S. Pat. No. 3,764,850 for a beam controller. The taper of the refocusing field depends on magnetic field strengths and electron velocities and trajectories to name a few parameters. Thus, the taper can be computed according to U.S. Pat. No. 3,764,850.

The collector 11 is similar to that shown in U.S. Pat. No. 3,702,951 and includes bowed collector plates 22, 23, 24 and 25, each of which has a central aperture. The end collector plate 26 is of conical shape and includes a spike 27 extending toward cathode 13 along the central axis of the tube 10 and the collector 11.

The required electrical potentials for electrodes 22 through 26 may be supplied from a voltage divider 28 by means of leads 29, 30, 31, 32 and 33, respectively. Negative voltage $V_o$ is applied to the voltage divider 28 at terminal 34 while the other end of voltage divider 28 is grounded as at 35. The cathode 13 of the gyrotron tube 10 is supplied with a negative potential via a lead 36 connected to a point on the voltage divider near its most negative end. The voltage divider 28 is shown only for purposes of clarity. It would be preferable to use taps on a transformer winding for greater efficiency.

Figure 2:
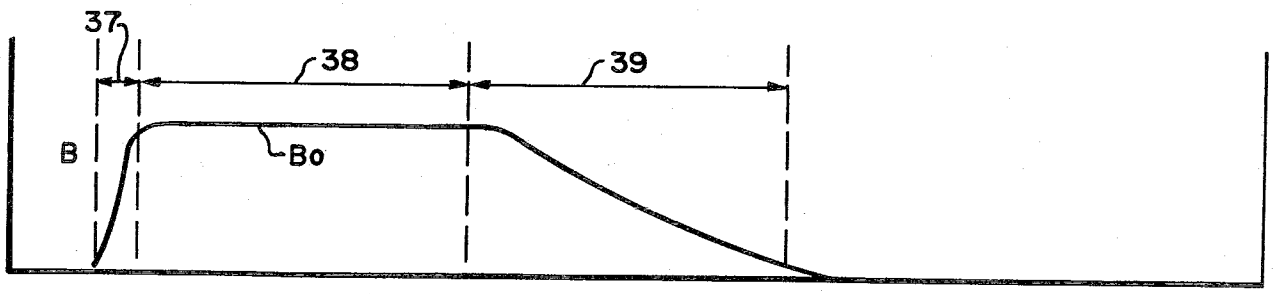
FIG. 2 is a graph of the magnetic field strength along the center of the gyrotron in a direction moving from left to right as viewed in the drawings.

Referring now to FIG. 2, there is shown a graph of the magnetic field strength in a direction from the cathode 13 of FIG. 1 to the focusing ring 18. The line $B_o$ representing magnetic field strength increases as shown between the cathode and the upstream end of the solenoid field over the distance represented by the double-ended arrow 37 and remains constant over the length of the solenoid field which is represented by the double-ended arrow 38.

The magnetic field of the refocusing coil 19 decreases from the solenoid field $B_o$ value to substantially zero between the solenoid field and the focusing ring, which distance is represented by double-ended arrow 39. The distance represented by arrow 39 is from one to three wavelengths as determined by the cyclotron frequency generated by the gyrotron tube 10.

Referring again to FIG. 1, the dashed lines 8 and 9 in collector 11 represent an envelope within which ideally all but generally 90 percent of the spent electrons injected into collector 11 will be contained as long as they are moving forward toward collector plate 26. Accordingly, it will be seen that the central aperture in each of the electrode plates 22 through 25 should be slightly greater than the envelope so that spent electrons do not impinge on the cathode-facing surfaces of those electrodes.

As the electrons fall back toward the focusing ring 18, they will take paths outside of the envelope represented by lines 8 and 9 and be captured on the back surfaces of the electrodes 22 through 25. The operation of the above-described embodiment of the invention may be more fully understood from the following discussion.

The potential energy of a magnetic dipole $\vec{M}$ in a magnetic field $\vec{B}$ is given by: $U=\vec{M}\cdot\vec{B}$. When the field changes slowly, $\vec{M}$ is adiabatically invariant, e.g. $|M|=\text{constant}$. Now the force on a dipole in a magnetic field is $\vec{F}=\nabla U=\nabla(\vec{M}\cdot\vec{B})=\vec{M}\nabla\cdot\vec{B}$. For an electron in a field B, $M=e\pi r^2\cdot\vec{n}$ where $\tau=(2\pi r/r\dot{\theta})=(2\pi/\dot{\theta})$ 1/fc, $\tau$ being the circulation time of an electron for one orbit and $\vec{n}$ representing a vector normal to the plane of orbit. If $B_o$ decreases slowly to $B\approx 0$ predominantly in the Z direction $B_Z>>Br$ then almost all of $U=\vec{M}\cdot\vec{B}$ will be converted into $\frac{1}{2}\,m\cdot Z^2$ if the decrease is over a distance Z equals from $1\lambda$ to $3\lambda$.

Thus, by imposing a tapering magnetic field on spent, spiraling electrons over a distance of from $1\lambda$ to $3\lambda$, the motion of the electrons becomes generally longitudinal along an axis centered in an imaginary envelop within which nearly all the spent, spiralling electrons lie.

It will be understood that changes and modifications may be made to the above-described invention without departing from its spirit and scope, as set forth in the claims appended hereto.

I claim:

1. An electromagnetic wave generator operating in the 20 GHz to 500 GHz range and comprising:

a gyrotron tube having an electron emitting cathode at one end;

an electron collector disposed at the other end of said gyrotron tube, said other end having disposed thereat a focusing ring through which electrons are injected into said collector;

a solenoid disposed around said gyrotron tube establishing a first magnetic field which causes electrons emitted by said cathode to follow helical paths; and means for establishing a second magnetic field between said first magnetic field and said focusing ring, said second magnetic field being characterized by decreasing from the B value of said first magnetic field to substantially zero over an axial distance of from $1\lambda_c$ to $3\lambda_c$ in a direction away from said cathode, and at such a rate as to establish optimum conversion of spiral energy of the spent electrons into forward motion.

2. The generator of claim 1 wherein said focusing ring is a coil having a d-c current flowing therethrough.

3. The generator of claim 1 wherein said means for establishing a second magnetic field comprises a coil disposed around said gyrotron between said solenoid and said collector.

4. The generator of claim 1 wherein said collector is a multistage depressed collector.

5. The generator of claim 4 wherein said multistage depressed collector comprises a plurality of centrally apertured plates bowed toward said cathode and a conical end electrode having a spike extending from its apex toward said cathode.

6. The generator of claim 5 wherein the aperture diameters increase at a rate at least as great as the rate of expansion of an imaginary envelope within which 90 percent of the electrons injected into said collector would be contained before falling back onto the collector plates.

7. The generator of claim 1 wherein said means for establishing a second magnetic field comprises a permanent magnet surrounding said gyrotron.

8. The generator of claim 1 wherein said means for establishing a second magnetic field comprises a superconducting magnet.

* * * * *